US005228149A

United States Patent [19]

Phinn, Jr.

[11] Patent Number: 5,228,149

[45] Date of Patent: Jul. 20, 1993

[54] FASTENING MEANS AND METHOD FOR SHOWER CURTAIN

[76] Inventor: Alex J. Phinn, Jr., 116 Delaware Ave. #5, Morrisville, Pa. 19067

[21] Appl. No.: 930,988

[22] Filed: Aug. 17, 1992

[51] Int. Cl.[5] ..... A47K 3/08

[52] U.S. Cl. ..... 4/558; 4/608; 33/645; 33/759

[58] Field of Search ..... 4/557, 558, 607, 608, 4/609; 33/758, 759, 645

[56] References Cited

U.S. PATENT DOCUMENTS

| | | | |
|---|---|---|---|
| 789,352 | 5/1905 | Badger | 33/758 |
| 3,365,684 | 1/1968 | Stemke et al. | 4/608 X |
| 4,077,072 | 3/1978 | Dezura | 4/608 X |
| 4,942,670 | 7/1990 | Brandt | 33/759 X |
| 5,107,601 | 4/1992 | Senchuck | 33/759 |
| 5,148,580 | 9/1992 | Dyckow | 4/608 X |

FOREIGN PATENT DOCUMENTS

| | | | |
|---|---|---|---|
| 1366948 | 6/1964 | France | 33/758 |

*Primary Examiner*—Henry J. Recla
*Assistant Examiner*—Robert M. Fetsuga
*Attorney, Agent, or Firm*—Daniel E. Kramer

[57] ABSTRACT

In a tub - shower environment comprising a tub enclosed on three sides by walls and open on the fourth side, where spray from the shower is intended to be retained within the tub - shower enclosure by a flexible shower curtain suspended from a curtain rod by hooks engaging grommet holes in the curtain and the rod, and extending across the open fourth side, between walls defining the ends of the tub - shower enclosure, there are provided mating pairs of hook-and-loop pads backed with waterproof pressure sensitive adhesive. The pads are positioned both on a vertical edge of the shower curtain and on the wall adjacent the shower curtain edge. A disposable rule is provided with means for attachment to a shower curtain hook. The rule is divided longitudinally into two portions, a curtain portion marked with indexes intended to guide positioning and attachment of one set of pads onto the curtain edge, and a wall portion marked with indexes intended to guide positioning and attachment of the mating pads to the adjacent wall. The positions of the curtain indexes are different from the positions of the wall indexes, whereby a tensioning effect is introduced into the curtain edge when the pairs of hook-and-loop pad are mated, thereby providing an effective seal between the curtain edge and the adjacent wall against undesired egress of shower spray.

4 Claims, 3 Drawing Sheets

FIG. 1
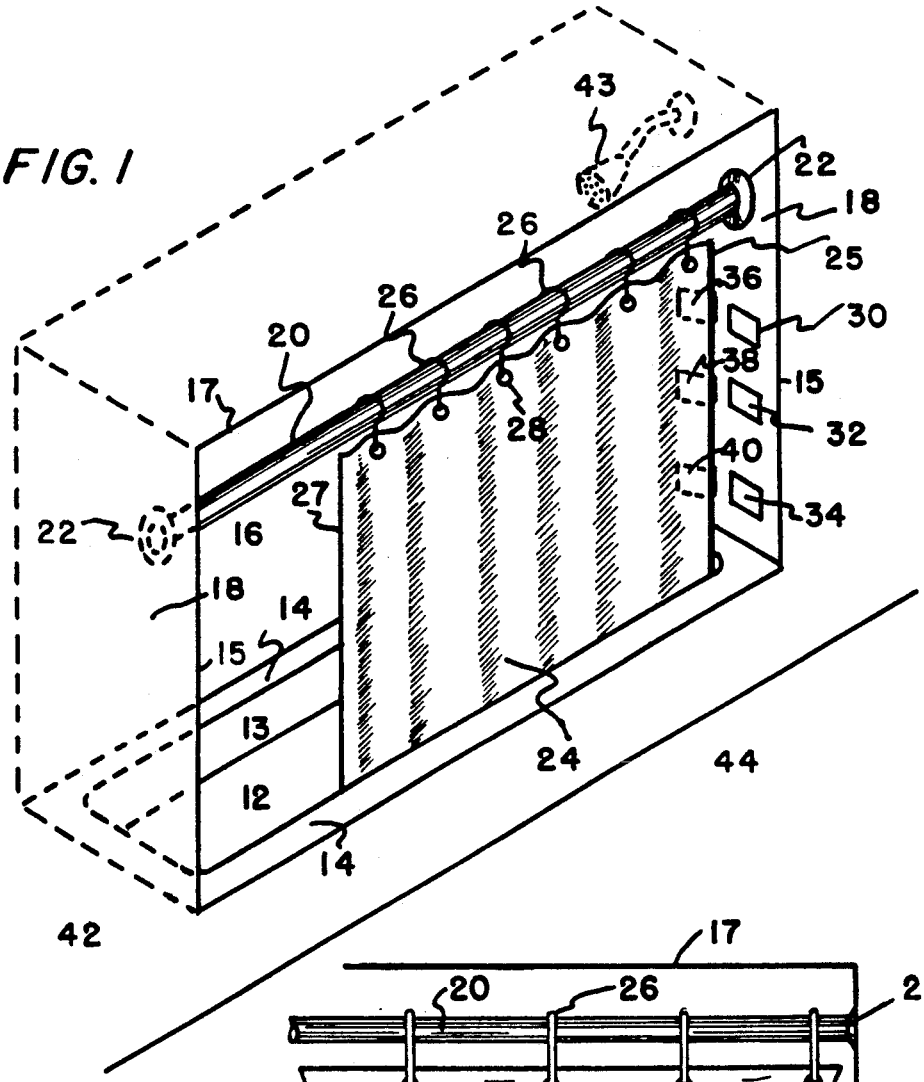
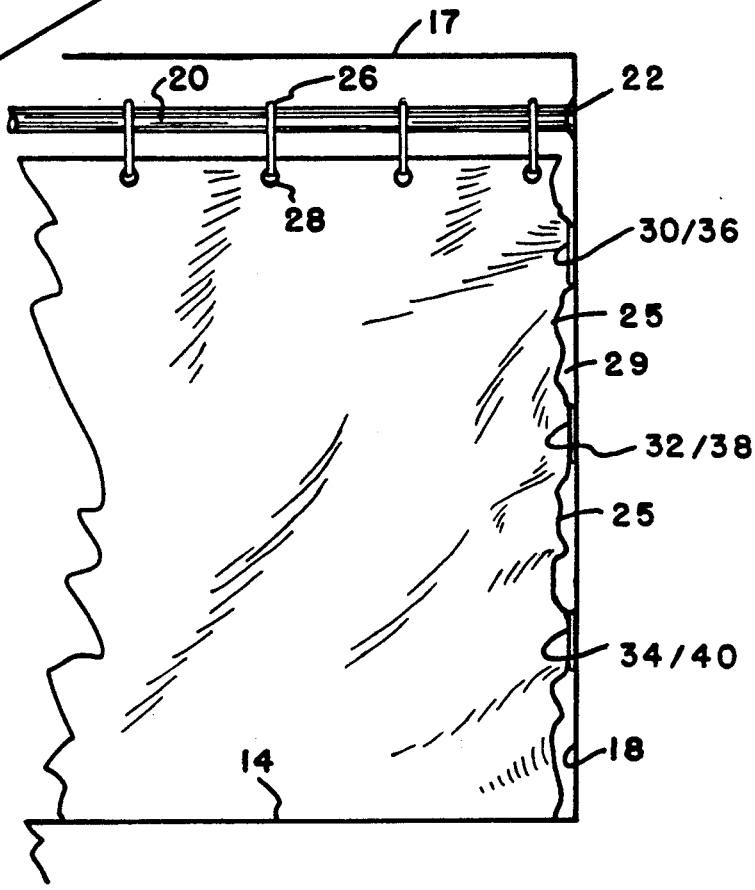
PRIOR ART
FIG. 2

FASTENING MEANS AND METHOD FOR SHOWER CURTAIN

FIELD OF THE INVENTION

The present invention relates to showers for human bathing enclosed on at least one side by a flexible curtain having an edge intended to more-or-less abut an adjacent wall. The invention is further directed to means for reversibly sealing the flexible curtain edge against the wall. The invention is further directed to such means including separable means commonly known as hook-and-loop fasteners and to means for determining the relative positions of the fasteners on the wall and on the curtain to better ensure a tight closure between the two.

BACKGROUND OF THE INVENTION

Before there were showers, there were tubs for human bathing. The tubs were generally installed in a bathroom. When pressurized domestic water systems became common, especially with a pressurized supply of hot water, shower-heads were installed to deliver a spray or stream of water, from a height, into the tub. It immediately became apparent to many fastidious users that means were required to retain within the tub area, spray emanating directly from the shower head and indirectly from the body of the bather. One of the early retaining means comprised an oval track, substantially surrounding the tub, on which a curtain, hung from hangers which were slidably mounted on the track.

As construction became modernized, the bathtub was integrated into the structure of the bathroom and a tub alcove comprising two shorter walls bounding the tub ends, both intersecting a longer side wall confining one tub side were provided. A straight rod was positioned over the open side of the tub at or above the height of the shower head. The ends of the rod were secured to the shorter walls. A shower curtain, formed of a flexible waterproof material, initially of oiled silk, more recently of polyethylene or similar plastic material, was provided. The curtain was manufactured with grommeted holes along one edge. Metallic or plastic hooks were provided to engage the grommeted holes in the curtain and the rod, thereby enabling the curtain to be hung from the rod.

Unfortunately, the edges of the curtain, though pulled as far as possible toward the shorter end walls, never succeeded in preventing spray from an energetic shower head from traversing the gap between the edge of the shower curtain and the adjacent wall. Various measures, most costly and more or less effective, were offered. Some of these measures included ties, hooks hanging from the wall to engage grommeted holes in the curtain edge, zippers and hook-and-loop strips and pads adhering to the curtain edge and the end walls.

One approach employing hook-and-loop pads, commonly referred to as "VELCRO" a trademark, is exemplified by U.S. Pat. No. 4,077,072 to Dezura, issued 7 Mar. 1978. Dezura positions a continuous hook/loop pad on the tub edge and the lower portion of the adjoining end wall, along with a series of small hook/loop pads mounted in corresponding positions on the curtain edge, thereby ensuring the curtain edge conforms to that intersection. Dezura also teaches small hook or loop pads at various intermediate positions along the curtain edge engaging much larger mating pads adhesively fastened to the end walls.

Dezura's solution to the spray and curtain - wall closure problem is both costly, because of the large areas of hook-loop material which are required to effect closure, and time consuming to apply, because of the multiplicity of pads which must be applied to the curtain. A further significant disadvantage arises when it is desired to remove the Dezura pads from the wall and tub surfaces. The cost and effort required to remove from a base, materials which have been attached to the base by adhesive, is a function of the area of the materials attached. In Dezura's construction, large pad areas are required and consequently a large amount of labor with large resulting costs must be expended when removal of his large pads are required.

My present invention, disclosed herein, also employs hook and loop pads or their equivalent, but it achieves a tight and effective seal between the curtain and the adjacent wall with relatively few and relatively small hook-loop pads required on both the curtain and the wall.

I achieve this desirable result by deliberately providing relatively small pads, the hook pads and the loop pads being of substantially equal size; and by providing a means for positively establishing the relative locations of the wall mounted pads with respect to the corresponding curtain mounted pads so that when the two are mated, there exists tension of the curtain between the rod and the points where the curtain pads and the wall pads are mated.

In one embodiment of my present invention the means for establishing the correct relative pad locations comprises a scale, typically fabricated of a suitable flexible material such as cloth, plastic sheet or paper, the scale including two sets of index marks, one set identifiable as applicable to the location of pads to the curtain, and a second set identifiable as applicable to the location of the mating pads to the wall. The scale is adapted to be suspended from the curtain rod by one of the same hangers employed to hang the curtain.

In another embodiment of my present invention the scale or the index marks alone are printed or otherwise identified on the edge of the curtain itself. That is, the material of the curtain comprises the base on which the index marks are located.

In yet another embodiment of my present invention, the curtain has the curtain pads already positioned and securely mounted in place, the curtain pads themselves constituting the curtain index. In this embodiment, the curtain edge has the indexes for correctly positioning the wall pads printed, embossed or otherwise identified on the curtain itself.

In yet another embodiment of my invention, one of each pair of curtain pads, joined and mated together by their respective hooks and loops are positioned on the curtain edge by the installer by her removing a protective waxed paper from the adhesive side of one pad and pressing and securing that pad in a position on the curtain edge. The protective waxed paper is removed from the other pad. The curtain edge is then stretched by the installer pulling down on the curtain edge and while stretched, the adhesive side of the other pad is pressed against the wall, thereby providing a taut interface between the curtain edge and the adjacent wall.

SUMMARY OF THE INVENTION

Briefly stated, the present invention comprises a shower curtain fastening means for providing temporary but secure fastening of the edge of a shower curtain to an adjacent wall. The curtain is supported by removable hangers from a rod. The means comprises a pair of planar elements each element having a first and a second side. Each pair comprises a hook element and a loop element. The elements have an adhesive coating on a first side for attachment to the curtain edge or the adjacent wall. The hook element further includes a hook layer on its second side, and the loop element further includes a loop layer on its second side. The hook layer and the loop layer form a separable union when pressed together. The fastening means also includes means for indicating the relative positions of the elements on the shower curtain edge and on the adjacent wall.

BRIEF DESCRIPTION OF THE DRAWINGS

The foregoing summary as well as the following description of preferred embodiments of the invention, will be better understood when read in conjunction with the appended drawings. For the purpose of illustrating the invention there are shown in the drawings embodiments which are presently preferred, it being understood, however, that the invention is not limited to the specific instrumentalities or the precise arrangement of elements disclosed.

FIG. 1 is an isometric view, looking downward on a shower curtain installed between enclosing walls in a tub alcove.

FIG. 2 is a front elevation of a shower curtain installed according to the prior art showing the gaps between the curtain edge and wall.

DETAILED DESCRIPTION OF THE INVENTION

Figure 3:
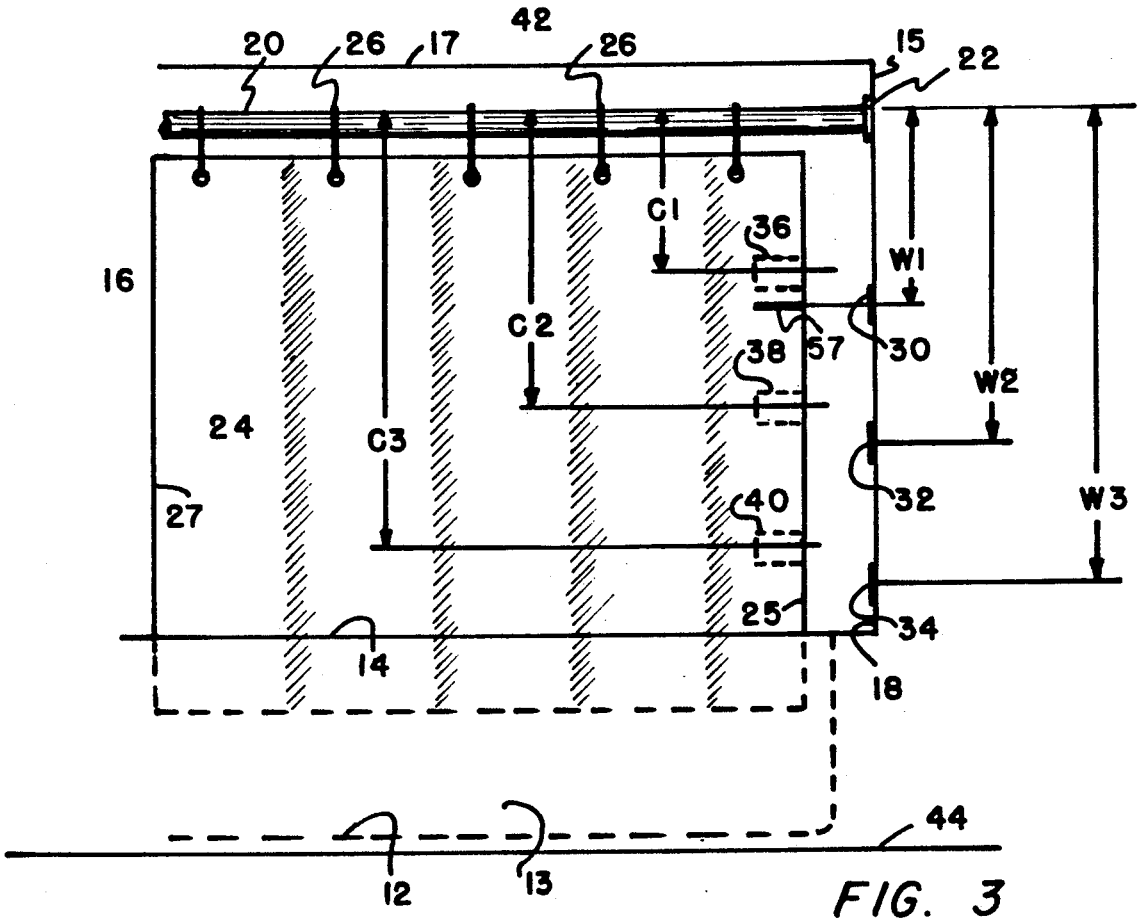
FIG. 3 shows the relative positions of pads on curtain and wall when installed according to the present invention along with a curtain mounted index.

Referring now to the drawings, wherein like references are used to indicate like elements, there is shown in FIG. 1 an isometric downward view of the front of the shower/tub/curtain alcove within which the present invention is intended to be employed. A tub having rim 14, tub floor 12 and inside walls 13 is set into bathroom wall 42. The bathroom wall 42 intersects bathroom floor 44. The alcove created by the set-in tub has end walls 18 which intersect at corner 15 with wall 42. Shower head 43 is provided for delivering water as a stream or spray to the occupant, not shown. Rod 20 is mounted between end walls 18 and held in place on each end wall 18 by end fitting 22.

Curtain 24 hangs from rod 20 via hooks 26. Hooks 26 engage both the grommeted holes 28 in the upper edge of curtain 24 and the rod 20. In this arrangement, curtain 24 is in two parts with the left-hand part not shown. The right hand end of curtain 24 has hook type pads 36, 38 and 40 positioned adjacent right hand edge 25. Located on right hand end wall 18, are loop type pads 30, 32 and 34. The wall mounted pads are positioned to allow their adjacent curtain mounted pads 36, 38 and 40, respectively, to engage them and provide a strong but releasable connection between them.

In other arrangements, curtain 24 is wide enough to stretch across the entire opening of the tub alcove. In the single curtain arrangement, the left hand edge 27 of curtain 24 is provided with hook and loop pads which are substantially identical to the pads 30 through 40 shown on the right along with mating wall mounted pads.

Referring now to FIG. 2, note that when the pad pairs are positioned randomly, the right hand curtain edge 25 is not taut. Consequently the curtain edge 25 gaps, that is, does not reside securely against end wall 18, and thereby allows spray, not shown, emanating directly or indirectly from the shower head to traverse the gaps 29 between the curtain edge 25 and wall 18.

FIG. 3 displays the relative positioning of the wall mounted pads and the curtain mounted pads in accord with the teaching of the present invention. Both the wall mounted pads 30, 32 and 34 and the curtain mounted pads 36, 38 and 40 are positioned at elevations or distances from the top of curtain support rod 20 which elevations or distances are predetermined to provide a taut shower curtain edge 25 adjacent end wall 18.

In order to ensure that the shower curtain edge 25 is taut after the curtain pads and the wall pads are mated, each pad on the shower curtain edge must be positioned at a distance from the top of the curtain rod 20 which is slightly less than the distance that the mating wall mounted pad is from the top of the shower curtain rod 20. I have found by a series of tests on different types and materials of shower curtains that a one percent reduction in the distance of the shower curtain pad from the top of rod 20, from the distance of the wall mounted pad from the top of rod 20 provides a satisfactory degree of tension, without unduly stressing the curtain or the material surrounding the grommets 28. For example, if wall mounted pad 30 is 36 inches below the top of curtain rod 20, then the mating pad 36, mounted on the edge 25 of shower curtain 24 must be about one percent closer to the top of curtain rod 20, or about $\frac{3}{8}$ inch closer, thereby establishing a distance from the wall pad to the top of curtain rod 20 of $35\frac{5}{8}$ inch. In all cases the origin for measuring distances can be either from the center of the pads or from an upper pad edge or from a lower pad edge, but the same origin must be employed for all measurements.

Figure 4:
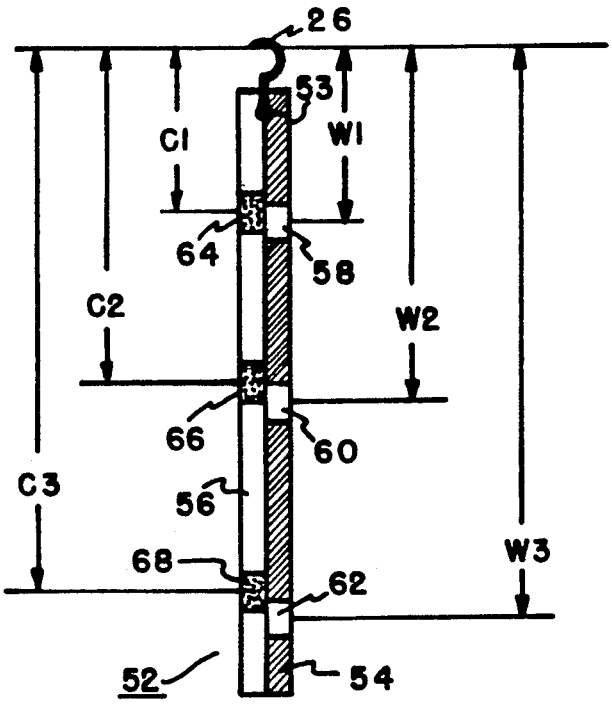
FIG. 4 shows a measuring tape including a wall set of positioning indexes and a curtain set of positioning indexes.

Generally, the relationship between the elevation or distance C of the curtain pad from the top of the curtain rod 20 is 0.99 times the elevation or distance W that the wall mounted pad is from the top of curtain rod 20. In FIGS. 3 and 4, the distance of the pads closest to the curtain rod 20 are designated C1 and W1, the next closest are designated C2 and W2 and so forth.

In FIG. 3, an index 57 for positioning wall pad 30 is shown marked on curtain 24, as an alternate construction.

In FIG. 4 a measuring tape 52 is provided with a reinforced hole 53 from which the tape 52 is hung from curtain rod 20 by the use of a curtain hook 26 which has been temporarily removed from a position at the left end of the curtain. The tape may be of any convenient material including cloth, plastic sheet or paper. By hanging the measuring tape 52 from the rod 20 the desired relative positions of the pads on both the shower curtain 24 and the wall 18 can be precisely determined. On the measuring tape 52, the indexes 58, 60 and 62 are distances W1, W2 and W3 from the top of rod 20 at which the wall mounted pads 30, 32 and 34 of FIG. 3 are to be mounted. On the measuring tape, the indexes 64, 66 and 68 are the distances C1, C2 and C3 that the curtain mounted pads 36, 38 and 40 of FIG. 3 are to be mounted. The positions of the indexes on the measuring tape are determined according to the 0.99 rule, though in other embodiments of the present invention, other multipliers are employed.

In FIG. 4, tape 52 is divided longitudinally into a darker hued portion 54 having lighter hued indexes 58, 60 and 62 for positioning wall elements, and a lighter hued portion 56 having darker hued indexes 64,66 and 68 for positioning the curtain elements.

In other embodiments of the present invention the portion 54 of darker hue and the associated indexes is on one side of the tape 52 and the lighter portion 56 with its associated indexes is on the other side of tape 52.

Where the pads are provided by the curtain manufacturer, multipliers different from 0.99 may be determined to be most effective, depending on the elasticity and strength of the curtain materials employed.

In still other embodiments of the present invention, the measuring tape may be made part of the end of the shower curtain adjacent the edge 25. In one subset of this embodiment the pads 36, 38 and 40 may be mounted on the shower curtain by the manufacturer and indexes 58, 60 and 62 for positioning the corresponding wall mounted pads may be permanently or temporarily marked on the curtain edge.

Figure 5:
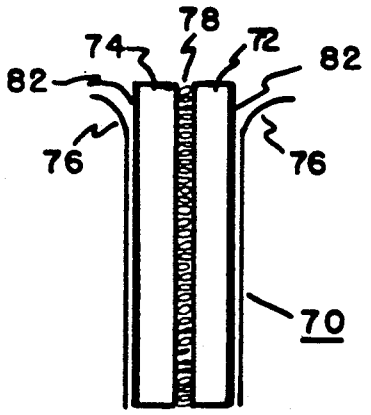
FIG. 5 shows a greatly enlarged side elevation of a mating pair of hook and loop pads.
Figure 6:
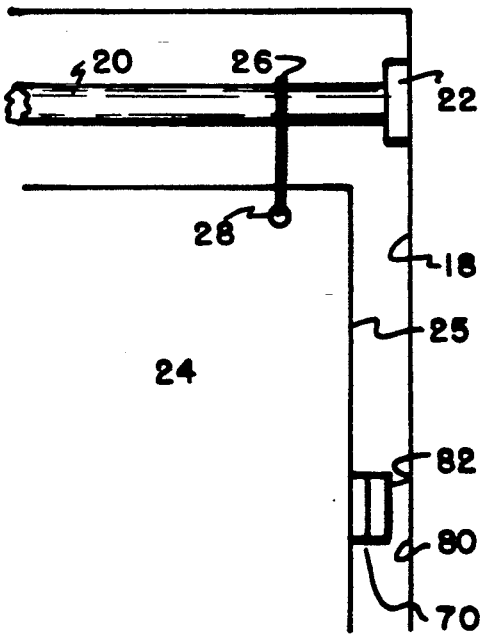
FIG. 6 shows one of a pair of hook and loop pads secured to a curtain edge in preparation for positioning and securing the other pad to the wall.

FIG. 5 shows assembly 70 consisting of hook pad 74 mated to loop pad 72 joined together by their hooks and loops at interface 78. Hook pad 78 has an adhesive coating 82 on its face opposite its hooks. The adhesive 82 is covered and protected by waxed paper 76 which is to be peeled away just prior to the application of the pad to the surface to which it is to be attached. Loop pad 72 has the same adhesive 82 covered by the same waxed paper 76, for the same purpose.

Figure 7:
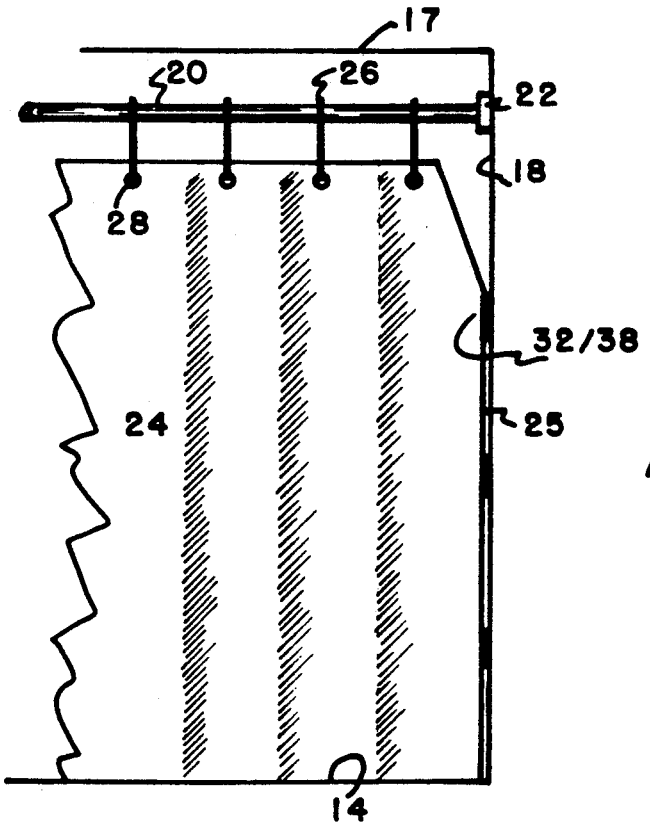
FIG. 7 shows a completed installation of pads by any of the means of this invention.

In accord with the process taught by the present invention, assembly 70 is positioned at any convenient spot on edge 25 of curtain 24 by peeling one waxed paper 76 from one adhesive surface 82 on either a hook or a loop pad of a joined pair. After the assembly 70 has been positioned on the curtain edge, the other waxed paper 76 of the other pad is removed. The curtain edge 25 is stretched by the installer pulling down on the curtain edge 25 and simultaneously pressing the unprotected adhesive layer 82 against wall surface 18, thereby correctly positioning the pads so that when they are joined by the bather a taut curtain edge 25 is established as shown in FIG. 7, thereby preventing egress of moisture from the shown into the non-bathing area.

It should be noted that in all embodiments of the present invention, the hook pad may be on the wall and the loop pads on the curtain or vice-versa.

From the foregoing description, it can be seen that the present invention comprises an improved apparatus and method for securing shower curtains to their adjacent shower stall walls and for positioning the pads or means by which the shower curtain edge is temporarily fastened to its adjacent wall. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. Shower curtain fastening means for providing substantially leak-tight temporary but secure fastening of the edge of a shower curtain to an adjacent wall, the curtain being supported by hangers from a rod, the means comprising at least two pairs of planar elements, each element having a first and a second side, each pair comprising a hook element including a hook layer on the first side and an adhesive coating on the second side, and a loop element including a loop layer on the first side and an adhesive layer on the second side, the adhesive layer providing means for attachment of one of a pair of elements to the curtain at a first elevation thereby defining curtain elements and the other of a pair of elements to the adjacent wall at a second elevation thereby defining wall elements, the hook layer and the loop layer forming a separable union when pressed together, and further including means, independent of the shower curtain, for indicating the desired elevation of each wall element with respect to the curtain rod and for indicating the desired elevation of each curtain element with respect to the curtain rod, said indicating means comprising an elongated flexible member having a reinforced perforation at one end for engagement with a curtain hanger, the elongated member further having a first positioning index which is visually identifiable as related to the elevation of the curtain elements and a second positioning index which is visually identifiable as related to the elevation of the wall elements, and further providing that the distance of the curtain element index from the curtain rod is shorter than the distance of the corresponding wall element index from the curtain rod.

2. Shower curtain fastening means as recited in claim 1 further providing that the elongated flexible means is divided with a dark portion having a less dark indexe identifying the elevation of a wall element and a light portion having a darker indexe identifying the elevation of a curtain element.

3. Shower curtain fastening means as recited in claim 2 further providing that the light portions and the dark portions are both on the same side of the elongated flexible means.

4. Shower curtain fastening means as recited in claim 2 further providing that the light portions and the dark portions are on opposite sides of the elongated flexible means.

* * * * *